US008863624B2

(12) United States Patent
Chen

(10) Patent No.: US 8,863,624 B2
(45) Date of Patent: Oct. 21, 2014

(54) TORQUE WRENCH WITH FUNCTIONAL LOCK

(71) Applicant: Zhu-Cun Chen, Taichung (TW)

(72) Inventor: Zhu-Cun Chen, Taichung (TW)

( * ) Notice: Subject to any disclaimer, the term of this patent is extended or adjusted under 35 U.S.C. 154(b) by 0 days.

(21) Appl. No.: 14/225,994

(22) Filed: Mar. 26, 2014

(65) Prior Publication Data

US 2014/0202292 A1 Jul. 24, 2014

Related U.S. Application Data

(63) Continuation-in-part of application No. 13/764,377, filed on Feb. 11, 2013.

(30) Foreign Application Priority Data

Mar. 5, 2012 (TW) ..... 101203941 U

(51) Int. Cl.
*B25B 23/14* (2006.01)
*B25B 23/159* (2006.01)
*B25B 23/142* (2006.01)

(52) U.S. Cl.
CPC ..... *B25B 23/1427* (2013.01)
USPC ..... 81/467; 81/483

(58) Field of Classification Search
USPC ..... 81/467, 483, 476, 462
See application file for complete search history.

(56) References Cited

U.S. PATENT DOCUMENTS

| | | | | | |
|---|---|---|---|---|---|
| 2,792,733 | A * | 5/1957 | Walraven et al. | ..... | 81/481 |
| 2,918,834 | A * | 12/1959 | Cranford | ..... | 81/481 |
| 4,655,104 | A * | 4/1987 | Blattner | ..... | 81/483 |
| 5,129,293 | A | 7/1992 | Larson et al. | | |
| 5,503,042 | A * | 4/1996 | Larson et al. | ..... | 74/527 |
| 6,948,410 | B1 * | 9/2005 | Larson | ..... | 81/467 |
| 8,245,606 | B2 * | 8/2012 | Chiang | ..... | 81/483 |
| 2011/0113936 | A1 * | 5/2011 | Chiang | ..... | 81/483 |

* cited by examiner

*Primary Examiner* — Monica Carter
*Assistant Examiner* — Danny Hong
(74) *Attorney, Agent, or Firm* — Muncy, Geissler, Olds & Lowe, P.C.

(57) ABSTRACT

A torque wrench with functional lock includes a hollow main shaft, a tool member, an adjustable grip, a torque-adjustment elastic member, a clutch device, and a functional lock. The locking ring axially moves along the main shaft between a locked position and an unlocked position. When the locking ring is in the locked position, the rotation of the adjustable grip against the hollow main shaft is limited. When the locking ring is in the unlocked position, the rotation of the adjustable grip against the hollow main shaft is allowed, whereby the torque is adjusted. Therein, a percussion sound is produced when the locking ring is switched between the locked position and the unlocked position.

15 Claims, 8 Drawing Sheets

TORQUE WRENCH WITH FUNCTIONAL LOCK

CROSS REFERENCE TO RELATED APPLICATIONS

This application is a Continuation-in-Part of co-pending application Ser. No. 13/764,377, filed on Feb. 11, 2013, for Which priority is claimed under 35 U.S.C. §120; and this application claims priority of Application No. 101203941 filed in Taiwan on Mar. 5, 2012 under 35 U.S.C. §119, the entire contents of all of which are hereby incorporated by reference.

BACKGROUND OF THE INVENTION

1. Field of the Invention

The present invention relates to torque wrenches, and more particularly, to a to a torque wrench with functional lock.

2. Description of the Related Art

A conventional wrench is known comprising a hollow main shaft, a tool member mounted at one end of the hollow main shaft for driving a screw nut or screw bolt, and an adjustable grip rotatably mounted at an opposite end of the hollow main shaft, and a clutch device and a spring member mounted inside the hollow main shaft and set between the tool member and the adjustable grip. The adjustable grip can be rotated to push the spring member, thereby changing the prestress of the spring member. The clutch device can be disengaged when the tool member receives a torque larger than the elastic prestress of the spring member, thereby limiting the torque acted on the tool member. Further, during clutch action of the clutch device, an escape percussion sound will be produced to notice the user of the problem that the applied force has been over the limit, avoiding screw nut or screw bolt damage.

U.S. Pat. No. 5,129,293 discloses a torque wrench tool 10, comprising a drive head 11 disposed in one end of a housing 17. The other end of the housing 17 is provided with a handle 22, while a lock ring retainer 20 is disposed between the handle 22 and the housing 17, wherein the lock ring retainer 20 is fastened to the periphery of a thimble 19 through a handle lock screw 21a. When torque value of the tool 10 is being adjusted, the handle lock screw 21a has to be unscrewed by a screwdriver, whereby the handle is allowed to be driven to rotate for adjusting. Such method of adjustment is inconvenient; in addition, when the user forgets to screw up the handle lock screw 21a, the wrench loosens easily, causing an incorrect torque value.

Also, U.S. Pat. No. 6,948,410 discloses another torque wrench 10, comprising a body 20 with a head 30 on one end and a handle 40 on the other end. A locking sleeve 50 is disposed between the handle 40 and the body 20, while the locking sleeve 50 is able to move between a locked position and an unlocked position along an axis A. Therein, as shown by FIG. 3, when the locking sleeve 50 is in the locked position, an annular wall 54 of a generally cylindrical rigid member 52 keeps a locking ball 60 radially inward and placed in a flute 28 axially positioned on the body 20, thereby limiting the rotation of the handle 40. As shown in FIG. 4 and FIG. 5, when the locking sleeve 50 is in the unlocked position, the handle 40 is allowed to rotate against the body 20, whereby the locking ball 60 is able to radially move and detach from the flute 28 for pressing an O-ring 58. Therefore, the handle 40 is allowed to be rotate in clockwise or counter clockwise against the body 20 for adjusting the torque. However, during the process of switching, the locking sleeve 50 is stopped against the locking ball 60 through the O-ring 58, so that the hand feeling during the position switching process between the locked position and the unlocked position is not obvious. As a result, the user may not notice that the wrench is not adjusted to the proper position, causing the inconvenience. At the same time, after being used for a period of time, the O-ring 58 tends to be deformed or damaged due to the environmental conditions.

SUMMARY OF THE INVENTION

The present invention discloses a torque wrench with a functional lock capable of slidingly moving between a locked position and an unlocked position, wherein an obvious hand feeling and a percussion sound are produced during the positional switching, whereby the user is aware of the switching status of the torque wrench.

For achieving the aforementioned objectives, the present invention provides a torque wrench with functional lock, comprising:

a hollow main shaft, provided with a first and a second end, while the outer periphery of the second end is axially provided with plural locating grooves;

a tool member, inserted into the first end of the hollow main shaft;

an adjustable grip, provided with an adjustment screw member screwed to the second end of the hollow main shaft;

a torque-adjustment elastic member, disposed inside the hollow main shaft and stopped against one end of the adjustment screw member;

a clutch device, disposed between the torque-adjustment elastic member and the tool member, and pushable by the torque-adjustment elastic member between an engaged position and a disengaged position;

a functional lock, disposed on the outer periphery of the second end of the hollow main shaft, axially moves between a locked position and an unlocked position along the hollow main shaft, and further comprising a medal locking ring mounted in between the second end of the hollow main shaft and the adjustable grip, with a containing groove disposed on one end of an inner side wall of the locking ring and a pushing face disposed on one side of the containing groove; a compression spring, disposed between the locking ring and the adjustable grip and permanently pushing against the locking ring; an annular groove, disposed on the other end of the inner wall of the locking ring; a C-clasp made of medal, disposed on one end of the adjustable grip for being optionally coupled with the annular groove; at least a through hole, disposed on the periphery of the adjustable grip; and at least a medal positioning ball, disposed in the through hole, wherein when the functional lock is in the locked position, the positioning ball is pushed by the pushed face to resist against the locating groove for limiting the rotation of the adjustable grip against the hollow main shaft, and when the functional lock is in the unlocked position, the C-clasp is coupled with the annular groove, enabling the positioning ball to move between the containing groove and the locating groove, whereby the adjustable grip is allowed to rotate against the hollow main shaft, while a percussion sound is produced when the locking ring is switched between the locked position and the unlocked position.

Therefore, during the switching of the locking ring, through the percussion sound produced by the medal C-clasp coupled with the annular groove and the sound produced by the pushing face pushing the positioning ball, the user is aware of the switching status of the torque wrench of the present invention, whereby the user is prevented from not knowing whether the wrench is properly adjusted or not, achieving the convenience of operation.

Furthermore, when the functional lock is in either the locked position or the unlocked position, the coupling or stopping relationships are produced between components made of medal. Therefore, the hand feeling of positioning during the operation is obvious, and each component is prevented from being damaged due to environmental factors during chronic usage.

DETAILED DESCRIPTION OF THE INVENTION

Figure 1:
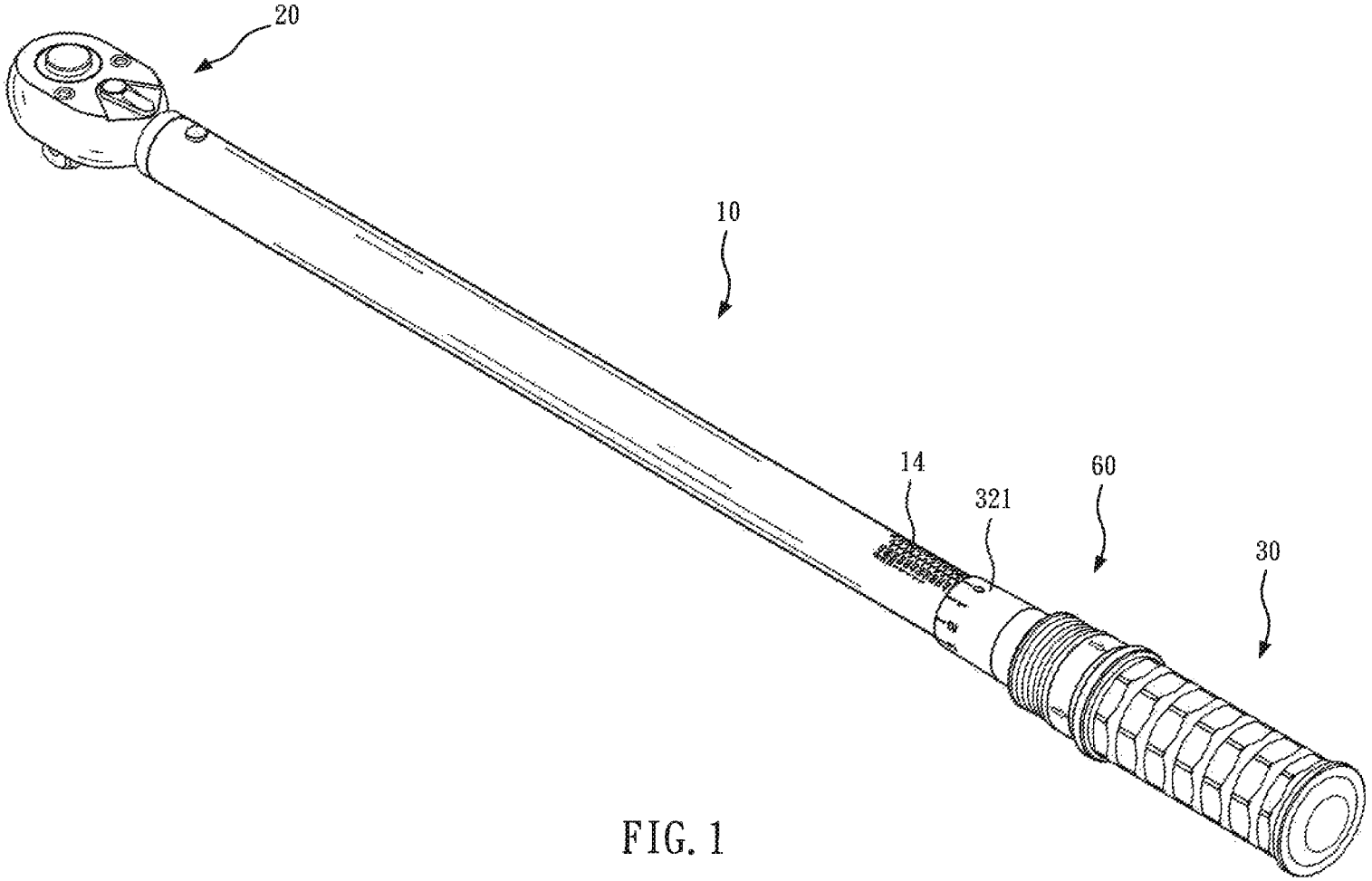
FIG. 1 is a perspective view of the torque wrench in accordance with the present invention.
Figure 2:
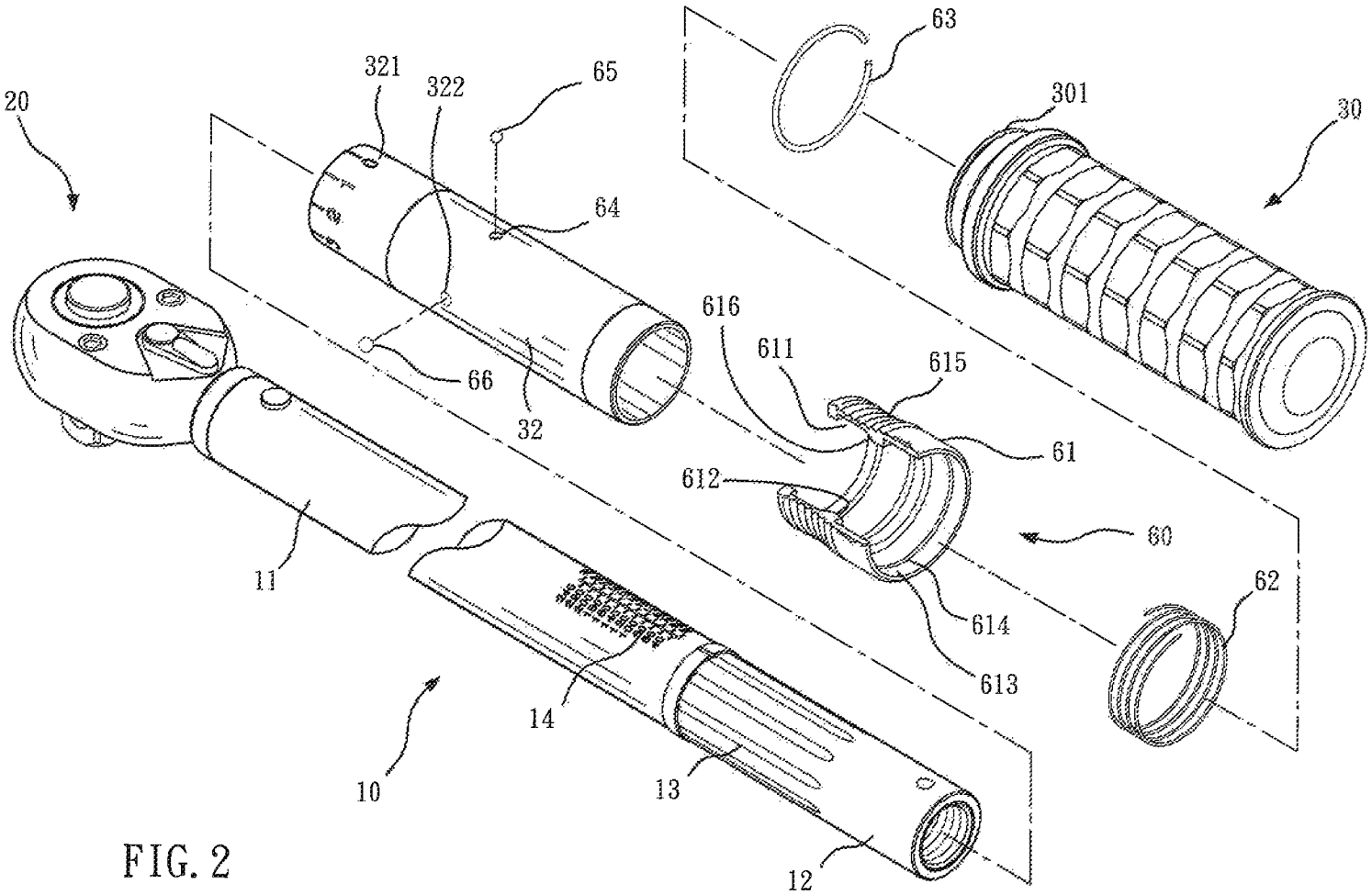
FIG. 2 is a partially exploded view of the torque wrench in accordance with the present invention.
Figure 3:
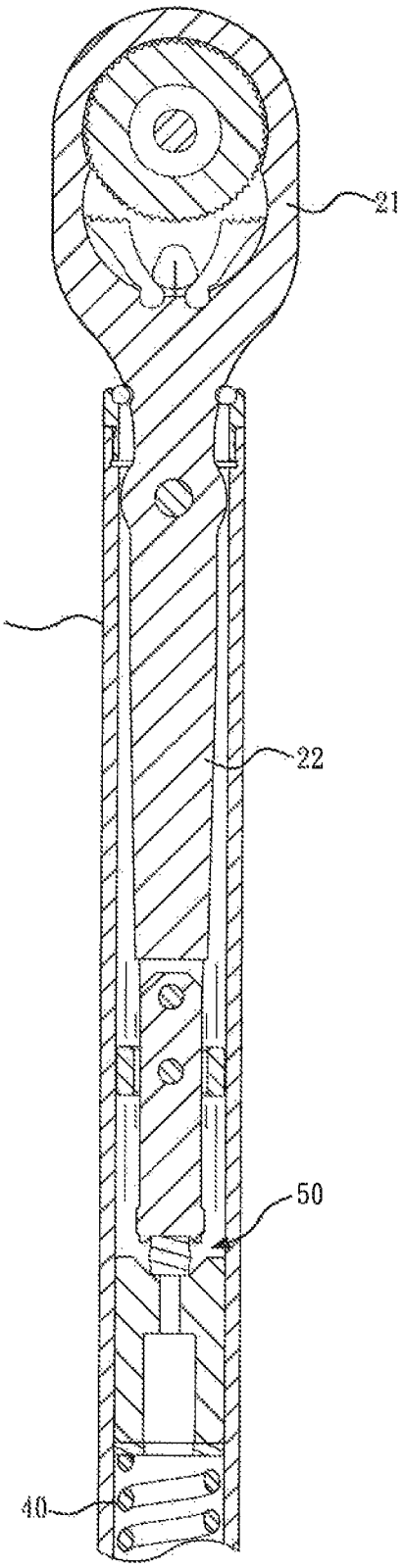
FIG. 3 is a partial sectional view of the torque wrench in accordance with the present invention.
Figure 4:
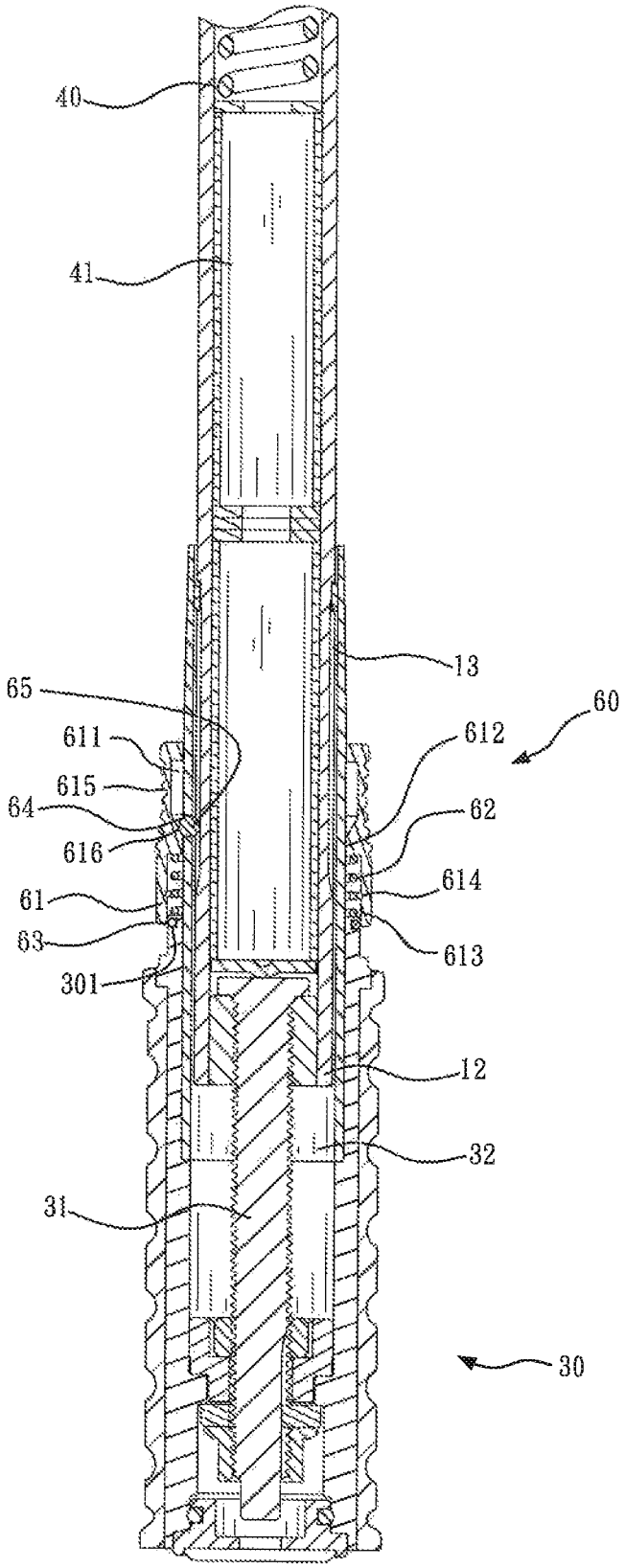
FIG. 4 is another partial sectional view of the torque wrench in accordance with the present invention.

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 4, the torque wrench with functional lock in accordance with the present invention comprises a hollow main shaft 10, a tool member 20, an adjustable grip 30, a torque-adjustment elastic member 40, a clutch device 50, and a functional lock 60.

Therein, the hollow main shaft 10 comprises a first end 11, a second end 12 opposite to the first end 11, and a plurality of locating grooves 13 spaced around the periphery of the second end 12, while plural torque value numbers 14 are disposed on the periphery of the hollow main shaft 10.

The tool member 20 comprises a head piece 21 made in the form of, for example, a ratchet socket joint, and a stem 22 inserted into the inside of the first end 11 of the hollow main shaft 10.

The adjustable grip 30 comprises an adjustment screw member 31 fixedly mounted therein on the center and screwed to the second end 12 of the hollow main shaft 10 for allowing the adjustable grip 30 to rotate against the hollow main shaft 10, with a ring groove 301 disposed on the periphery of one end of the adjustable grip 30 opposite to the end combined to the hollow main shaft 10.

The torque-adjustment elastic member 40 mounts inside the hollow main shaft 10 and is stopped against one end of the adjustment screw member 31. Preferably, at least a stopper member 41 is disposed between the torque-adjustment elastic member 40 and one end of the adjustment screw member 31 for allowing the torque-adjustment elastic member 40 to be indirectly stopped against one end of the adjustment screw member 31.

The clutch device 50 is set between the torque-adjustment elastic member 40 and the tool member 20, pushable by the torque-adjustment elastic member 40 between an engaged position and a disengaged position. Preferably, the clutch device 50 includes a plurality of block members movable by the torque-adjustment elastic member 40 to abut against one another.

The functional lock 60 is disposed on the outer periphery of the second end 12 of the hollow main shaft 10 and axially moveable between a locked position and an unlocked position along the hollow main shaft 10.

Therein, the functional lock 60 comprises a locking ring 61, a compression spring 62, a C-clasp 63, at least a through hole 64, and at least a positioning ball 65.

The locking ring 61 mounts in between the second end 12 of the hollow main shaft 10 and the adjustable grip 30, with a containing groove 611 disposed on one end of the inner wall of the locking ring 61, a pushing face 612 axially extending from the containing groove 611 toward the adjustable grip 30, and a spring groove 613 disposed on the other end of the inner wall of the locking ring 61. An annular groove 614 is disposed in the spring groove 613, while the inner diameter of the spring groove 613 is smaller than the inner diameter of the annular groove 614. In addition, an anti-sliding portion 615 comprising plural ditches mounts around the outer periphery of the locking ring 61, and the pushing face 612 is located in a position higher than the groove bottom of the containing groove 611. A bevel 616 is disposed on the junction between the containing groove 611 and the pushing face 612.

The compression spring 62 is disposed between the locking ring 61 and the adjustable grip 30 and permanently pushing the locking ring 61.

The C-clasp 63 is made of medal and disposed on a ring groove 301 of the adjustable grip for being optionally coupled with the annular groove 614, whereby the locking ring 61 is located in the unlocked position.

At least a through hole 64 is disposed on the periphery of the adjustable grip 30. Preferably, the adjustable grip 30 comprises a hollow extension tube 32 sleeving the locating groove 13, and the through hole 64 is disposed on the periphery of the extension tube 32, while one end of the extension tube 32 is provided with plural level value numbers 321 as a reference corresponding to the torque value number 14 on the hollow main shaft 10. The periphery of the extension tube 32 is provided with a position limiting hole 322 which is 90 degrees apart from the through hole 64 on the periphery of the extension tube 32. The distance between the position limiting hole 322 and the adjustable grip 30 is longer than the distance between the through hole 64 and the adjustable grip, while a position limiting ball 66 is received in the position limiting hole 322 for limiting the movement of the locking ring 61.

The at least one positioning ball 65 made of medal is received in the through hole 64 for corresponding with the locating groove 13, wherein the diameter of the positioning ball 65 is smaller than the diameter of the position limiting ball 66.

Figure 5:
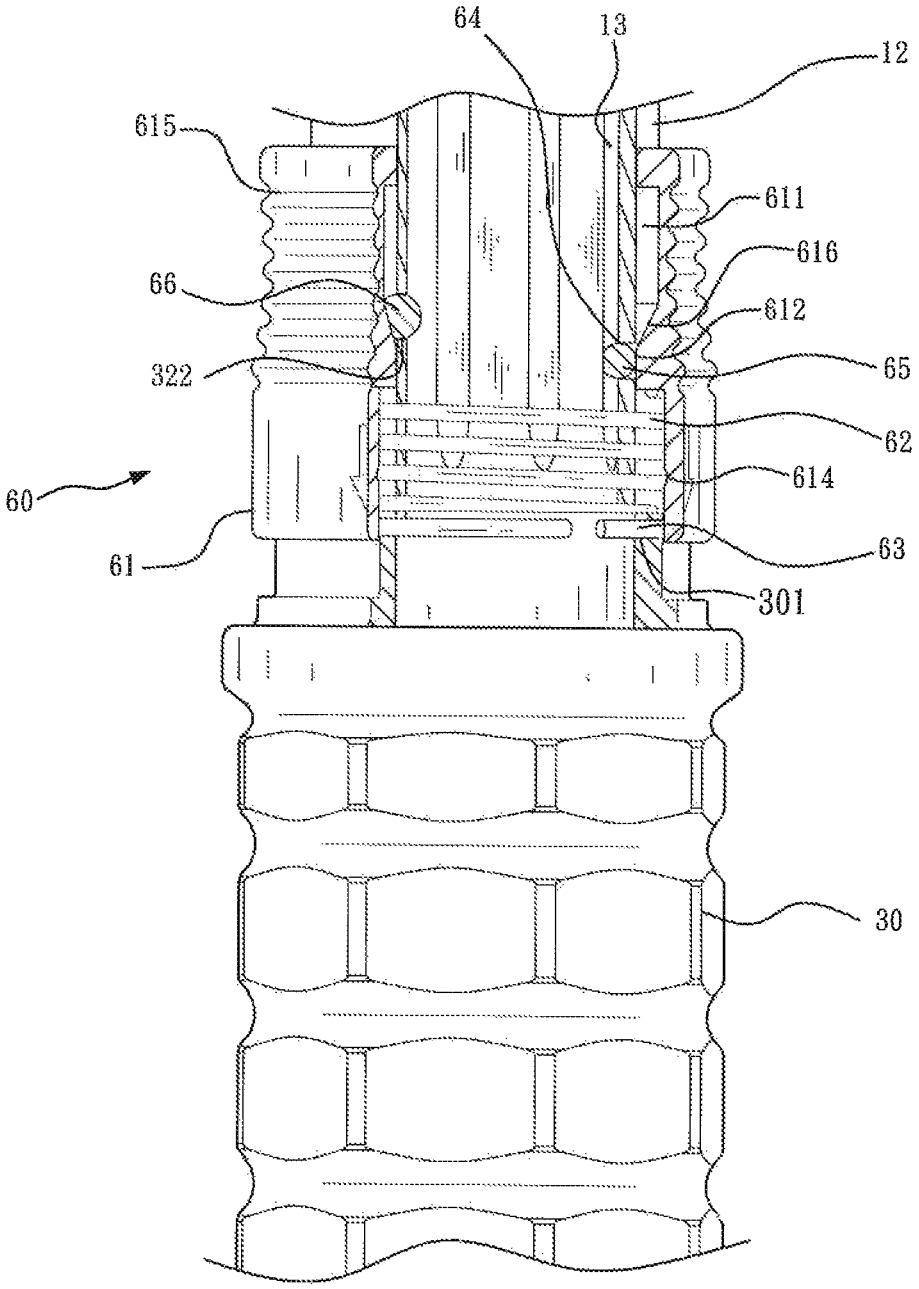
FIG. 5 is a sectional schematic view illustrating the status of the functional lock in the locked position.

Referring to FIG. 5, when the functional lock 60 is in the locked position, the compression spring 62 permanently pushes the locking ring 61 toward the tool member 20, whereby the positioning ball 65 is pushed by the pushing face 612 and stopped by the locating groove 13 for limiting the rotation of the adjustable grip 30 against the hollow main shaft 10.

Figure 6:
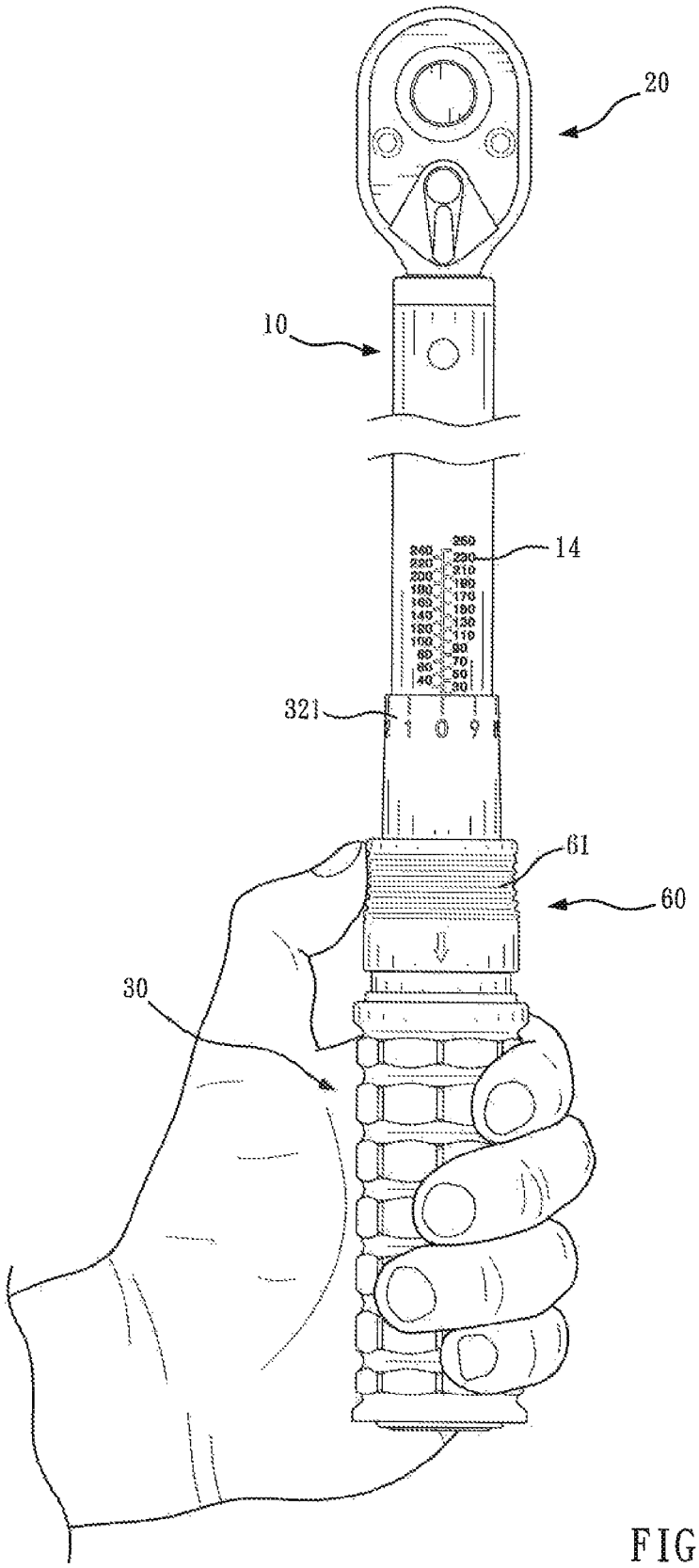
FIG. 6 is a schematic view illustrating the adjustment operation of the torque wrench in accordance with the present invention, wherein the locking ring pushes toward the unlocked position.

Referring to FIG. 6, when the torque of the torque wrench needs to be adjusted, the user is allowed to operate the locking ring 61 of the functional lock 60 by on hand and push the locking ring 61 toward the adjustable grip 30 by fingers of the hand, whereby the functional lock 60 slidingly moves from the locked position to the unlocked position.

Figure 7:
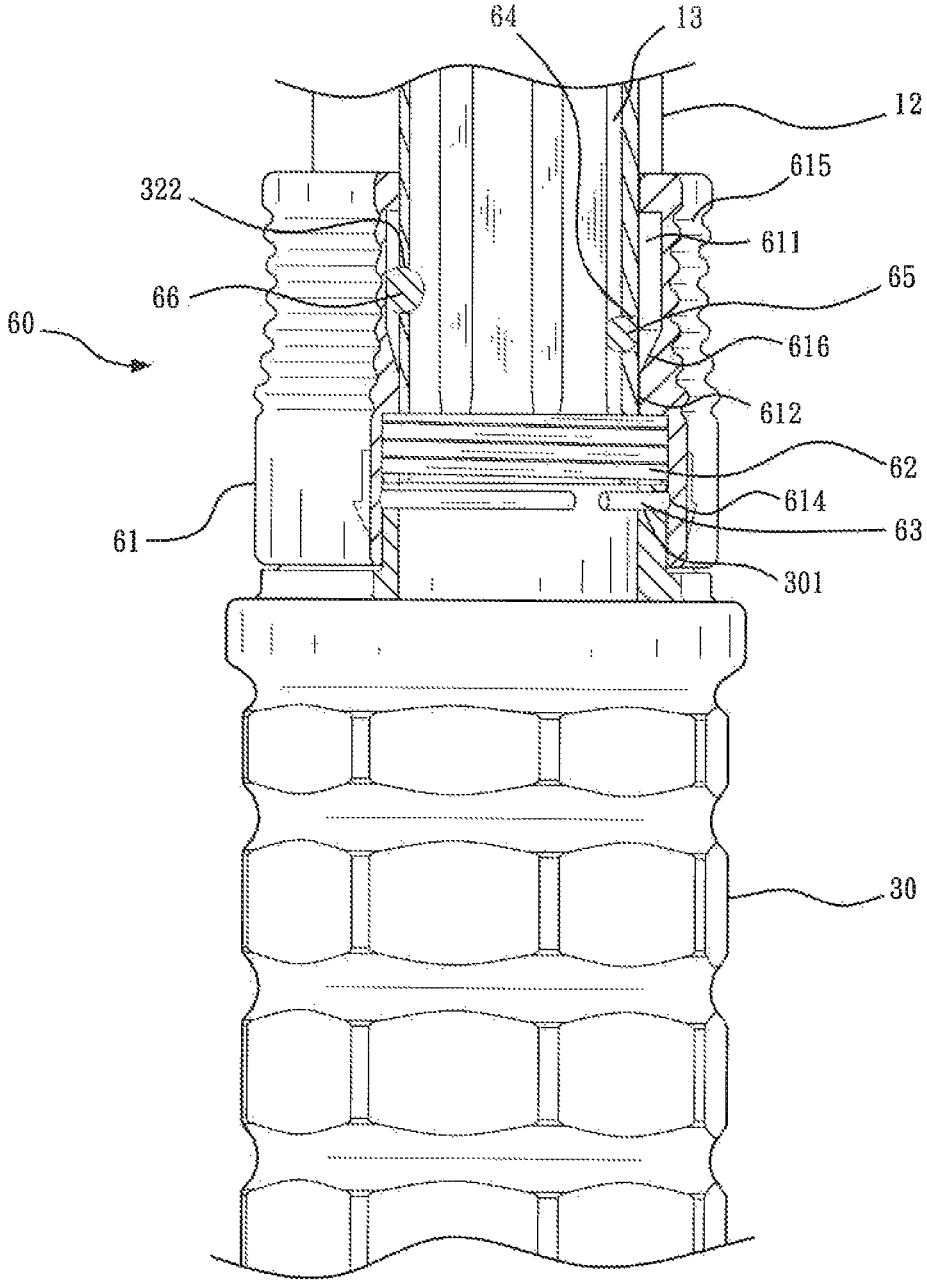
FIG. 7 is a sectional schematic view illustrating the status of the functional lock in the unlocked position.
Figure 8:
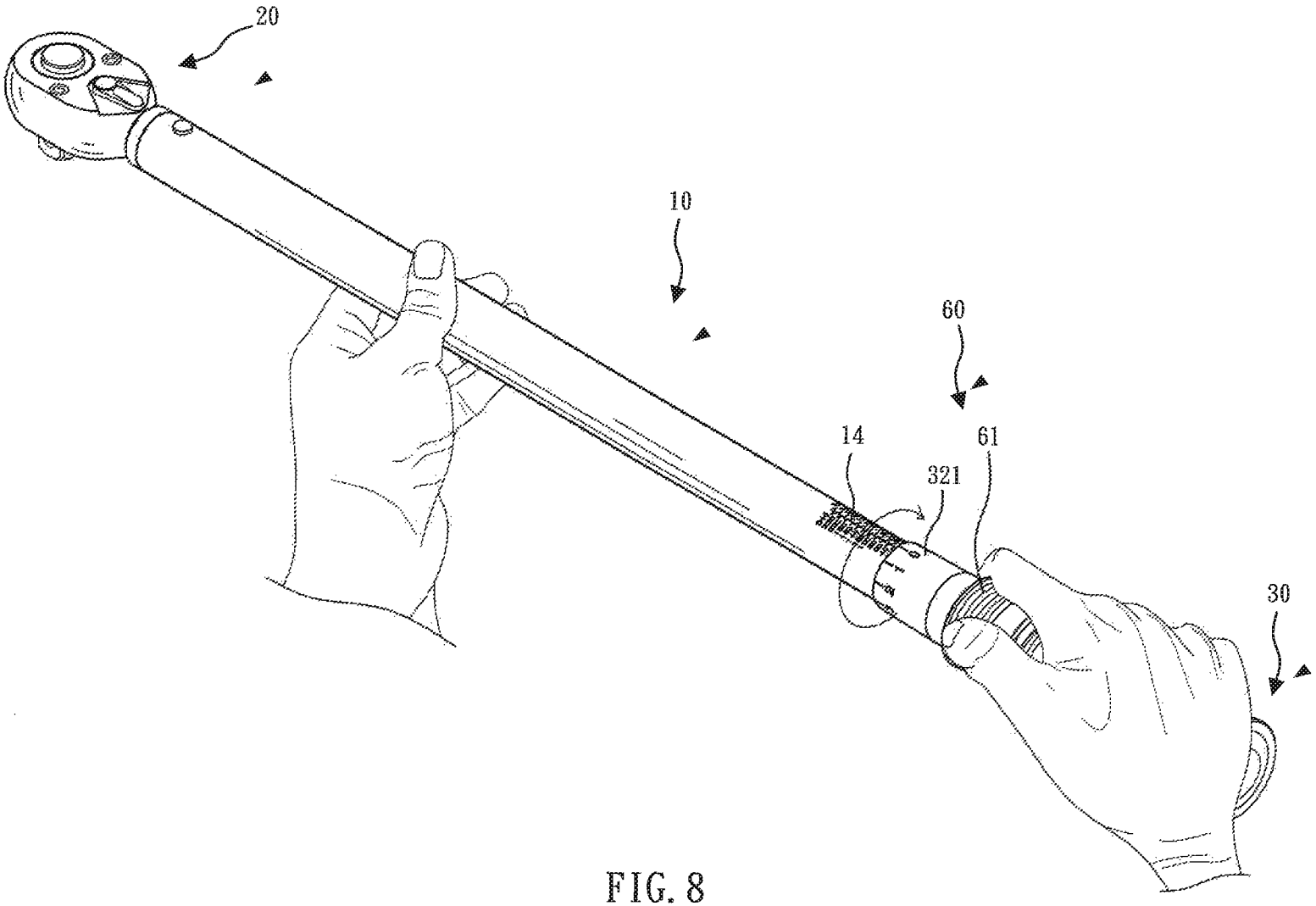
FIG. 8 is a schematic view illustrating the torque adjustment of the torque wrench in accordance with the present invention.

Referring to FIG. 7 and FIG. 8, when the functional lock 60 is in the unlocked position, the compression spring 62 is compressed due to the movement of the locking ring 61, whereby the C-clasp 63 is coupled with the annular groove 614 for positioning the locking ring 61 in the unlocked position. At the meantime, the positioning ball 65 is no longer pushed by the pushing face 612 and is aligned with the position of the bevel 616, whereby the positioning ball 65 is allowed to move between the containing groove 611 and the locating groove 13. The function of the bevel 616 is to facilitate the positioning ball 65 moving between the containing groove 611 and the pushing face 612, whereby the adjustable grip 30 is allowed to rotate against the hollow main shaft 10. As a result, the user is allowed to grip the adjustable grip 30 by one hand and at the same time grip the hollow main shaft 10 by the other hand, thereby adjusting the torque of the torque wrench, as shown by FIG. 9.

Therefore, during the torque adjustment, the user does not need to pull or press the locking ring 61 by use of the other hand, achieving the convenience of operation. Also, during the switching process of the locking ring 61, a percussion sound is produced by the medal C-clasp 63 coupled with the annular groove 614, and another percussion sound is also produced when the pushing face 612 pushes the positioning ball 65. As a result, through the percussion sound produced during the functional lock 60 being switched, the user is aware of the status of the wrench switching, prevented from not knowing whether the wrench is properly adjusted or not, achieving the convenience of operation.

Furthermore, when the functional lock is in either the locked position or the unlocked position, the coupling or stopping relationships are produced between components made of medal. Therefore, the hand feeling of positioning during the operation is obvious, and each component is prevented from being damaged due to environmental factors during chronic usage.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A torque wrench with functional lock, comprising:

a hollow main shaft, provided with a first and a second end, while the outer periphery of the second end is axially provided with plural locating grooves;

a tool member, inserted into the first end of the hollow main shaft;

an adjustable grip, provided with an adjustment screw member screwed to the second end of the hollow main shaft;

a torque-adjustment elastic member, disposed inside the hollow main shaft and stopped against one end of the adjustment screw member;

a clutch device, disposed between the torque-adjustment elastic member and the tool member, and pushable by the torque-adjustment elastic member between an engaged position and a disengaged position;

a functional lock, disposed on the outer periphery of the second end of the hollow main shaft, axially moves between a locked position and an unlocked position along the hollow main shaft, and further comprising a metal locking ring mounted in between the second end of the hollow main shaft and the adjustable grip, with a containing groove disposed on one end of an inner side wall of the locking ring and a pushing face axially extending on one side of the containing groove; a compression spring, disposed between the locking ring and the adjustable grip and permanently pushing the locking ring; an annular groove, disposed on the other end of the inner wall of the locking ring; a C-clasp made of metal, disposed on one end of the adjustable grip for being optionally coupled with the annular groove; at least a through hole, disposed on the periphery of the adjustable grip; and at least a metal positioning ball, disposed in the through hole, wherein when the functional lock is in the locked position, the positioning ball is pushed by the pushing face to resist against the locating groove for limiting the rotation of the adjustable grip against the hollow main shaft, and when the functional lock is in the unlocked position, the C-clasp is coupled with the annular groove, enabling the positioning ball to move between the containing groove and the locating groove, whereby the adjustable grip is allowed to rotate against the hollow main shaft, while a percussion sound is produced when the locking ring is switched between the locked position and the unlocked position.

2. The torque wrench of claim 1, wherein a ring groove is disposed on the periphery of one end of the adjustable grip for receiving the C-clasp.

3. The torque wrench of claim 1, wherein a spring groove is disposed on the inner wall of the locking ring with the annular groove disposed in the spring groove, and the compression spring is received in the spring groove with one end pushing the locking ring and the other end pushing one end of the adjustable grip.

4. The torque wrench of claim 3, wherein the inner diameter of the spring groove is smaller than the inner diameter of the annular groove.

5. The torque wrench of claim 1, wherein the adjustable grip further comprises a hollow extension tube capable of sleeving the locating groove, and the through hole is disposed on the periphery of the extension tube.

6. The torque wrench of claim 5, wherein one end of the extension tube is provided with plural level value numbers, and the periphery of the hollow main shaft is provided with plural torque value numbers corresponding to the level value numbers.

7. The torque wrench of claim 5, wherein the periphery of the extension tube is provided with a position limiting hole with a position limiting ball received therein for limiting the movement of the locking ring.

8. The torque wrench of claim 7, wherein the position limiting hole is 90 degrees apart from the through hole on the periphery of the extension tube.

9. The torque wrench of claim 7, wherein the distance between the position limiting hole and the adjustable grip is longer than the distance between the through hole and the adjustable grip.

10. The torque wrench of claim 7, wherein the diameter of the positioning ball is smaller than the diameter of the position limiting ball.

11. The torque wrench of claim 1, wherein the tool member comprises a head piece and a stem inserted into the inside of the first end of the hollow main shaft.

12. The torque wrench of claim 1, wherein at least a stopper member is disposed between the torque-adjustment elastic member and the adjustment screw member.

13. The torque wrench of claim 1, wherein an anti-sliding portion comprising plural ditches mounts around the outer periphery of the locking ring.

14. The torque wrench of claim 1, wherein the pushing face is located in a position higher than the groove bottom of the containing groove.

15. The torque wrench of claim 1, wherein a bevel is disposed on the junction between the containing groove and the pushing face.

* * * * *